United States Patent [19]

Aarestad

[11] Patent Number: 4,729,727

[45] Date of Patent: Mar. 8, 1988

[54] GEAR PUMP WITH GROOVE IN END WALL BEGINNING AT OUTER PERIPHERY OF PUMPING CHAMBER AND WIDENING TOWARD GEAR TEETH ROOTS

[75] Inventor: Jerome K. Aarestad, Rockford, Ill.

[73] Assignee: Sundstrand Corporation, Rockford, Ill.

[21] Appl. No.: 812,196

[22] Filed: Dec. 23, 1985

[51] Int. Cl.[4] ..... F04C 18/08; F04C 29/08

[52] U.S. Cl. ..... 418/78; 131/184; 131/206

[58] Field of Search ..... 418/75, 78, 131, 189, 418/190, 206, 3, 74, 71

[56] References Cited

U.S. PATENT DOCUMENTS

| | | | |
|---|---|---|---|
| 1,863,160 | 6/1932 | Jensen | 418/189 |
| 1,937,367 | 11/1933 | Vickers | 418/74 |
| 2,212,994 | 8/1940 | Vrolix | 418/74 |
| 2,281,767 | 5/1942 | Heckert | 418/78 |
| 2,287,318 | 6/1942 | McIntyre | 418/74 |
| 2,424,751 | 7/1947 | Heckert | 137/3 |
| 2,541,010 | 2/1951 | Ungar | 418/74 |
| 2,624,287 | 1/1953 | Ilyin | 418/78 |
| 2,865,302 | 12/1958 | Murray | 418/78 |
| 2,884,864 | 5/1959 | Bobnar | 418/189 |
| 2,887,064 | 8/1959 | Say | 418/78 |
| 3,057,303 | 10/1962 | Lauck | 418/78 |
| 3,203,355 | 8/1965 | Purcell | 418/78 |
| 3,204,564 | 9/1965 | Eltze | 418/78 |
| 3,251,309 | 5/1966 | Schmiel et al. | 418/78 |
| 3,276,387 | 10/1966 | Bottoms | 418/170 |
| 3,781,149 | 12/1973 | Weaver et al. | 418/131 |
| 4,231,726 | 11/1980 | Cobb et al. | 418/75 |
| 4,343,602 | 8/1982 | Meywald et al. | 418/77 |
| 4,355,964 | 10/1982 | Rodibaugh et al. | 418/76 |

*Primary Examiner*—Carlton R. Croyle
*Assistant Examiner*—Jane E. Obee
*Attorney, Agent, or Firm*—Wood, Dalton, Phillips, Mason & Rowe

[57] ABSTRACT

A gear pump which includes a pair of intermeshing gears. A housing defines a pumping chamber having peripheral walls surrounding and in sealing contact with the circumference of the gears between an inlet port and a discharge port. Bearing walls are adapted to engage adjacent side faces of the gears in substantially sealing relation. Grooves are provided in the bearing walls for progressively admitting pressure to the gear teeth as the gear teeth move toward the discharge port. The grooves are acruately shaped and diverge toward the discharge port from a point intermediate the inlet and discharge ports and allow compressed air in the liquid to be gradually displaced by liquid under pressure from the pump discharge.

6 Claims, 6 Drawing Figures

FIG. 1
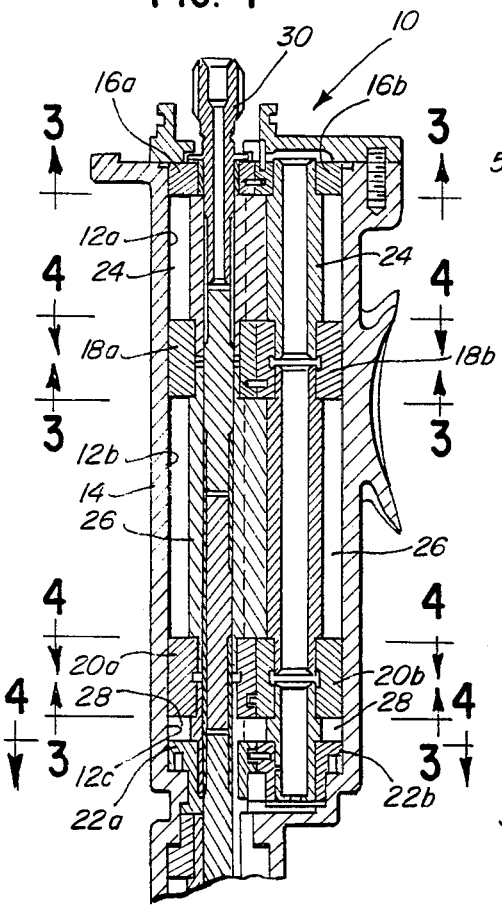
FIG. 3
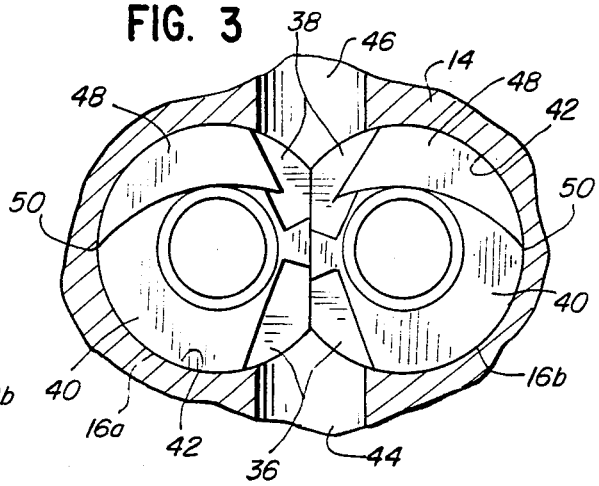
FIG. 4
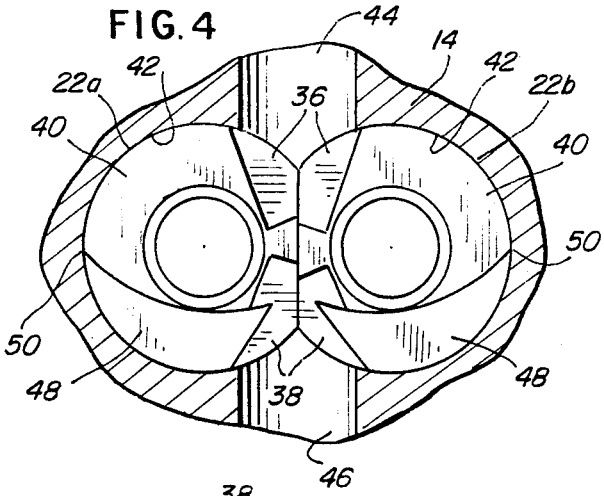
FIG. 5
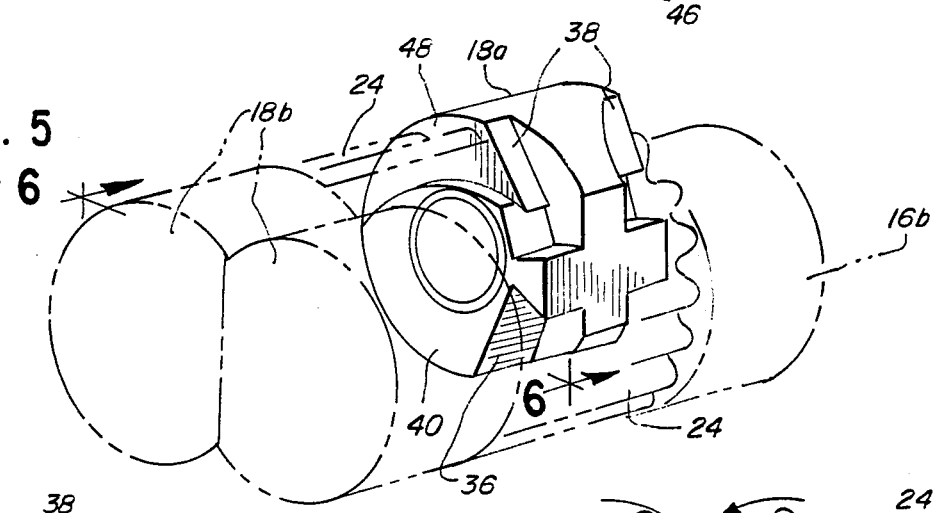
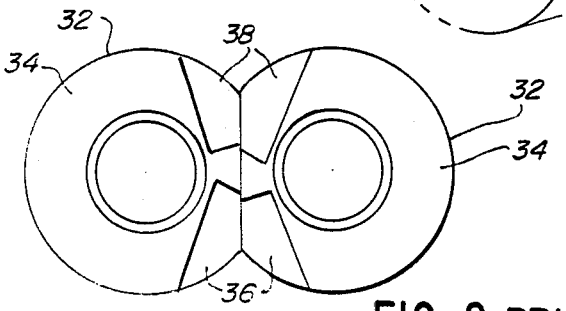
FIG. 2 PRIOR ART
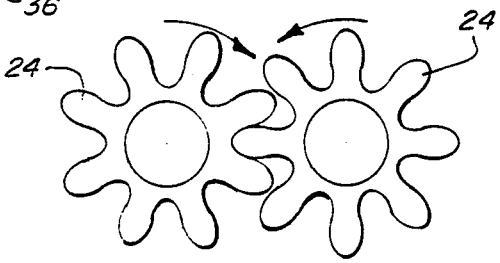
FIG. 6

GEAR PUMP WITH GROOVE IN END WALL BEGINNING AT OUTER PERIPHERY OF PUMPING CHAMBER AND WIDENING TOWARD GEAR TEETH ROOTS

DESCRIPTION

1. Field Of The Invention

This invention relates to rotary fluid displacement pumps and, particularly, to positive displacement gear pumps.

2. Background Of The Invention

In general, so-called positive displacement pumps and particularly rotary piston pumps are used for the conveyance of viscous liquids. A particular form of these rotary piston pumps are gear pumps in which two generally equally sized intermeshed gears constitute the rotary pistons. The gears are mounted for rotation in a housing having an inlet port at one side of the area of interengagement of the teeth of the gears, and a discharge port in the housing at the other side of that area. When the inlet port of such a pump is connected to a source of liquid, rotation of the gears will cause the liquid to be drawn through the inlet port into the housing and carried around in pockets between adjacent teeth of both gears and the peripheral bounds of a pumping chamber defined by the housing before delivery into a system through the discharge port. The liquid is drawn into the housing due to the increasing free space within the pumping chamber adjacent the inlet port as the teeth move out of engagement, and is discharged due to the decreasing free space within the pumping chamber adjacent the discharge port as the teeth move into engagement, the inlet and discharge ports being substantially isolated from one another by the small clearances between the teeth of the wheels and the housing or pumping chamber.

The intermeshed gears normally have generally flat side faces and the pumping chamber is defined, in part, by side bearings or plates defining end walls adapted to engage the adjacent side faces of the gears in substantially sealing relation. It is known that cavitation erosion or destruction similar to corrosion in appearance is likely to be encountered on the side walls of the bearings or plates effecting the seal with the side faces of the gears, particularly in the vicinity of the zone of intermesh. This is particularly true in high altitude scavenge pumps used in aircraft applications.

To better understand the phenomenon of cavitation erosion, it should be noted that there normally is a pressure reduction from a source of liquid supply to the pump inlet port, often due to line losses. The vicinity of the inlet pump always is the lowest pressure point of the entire system. Consequently, air bubbles form as air comes out of solution due to the pressure drop. As the gear geeth carry their volume of liquid around the pumping chamber, the liquid pressure changes very little. However, as the liquid reaches the discharge port, it reaches a "hydraulic front". This instantaneous pressure increase causes the air to implode back into solution. In other words, during solid oil conditions, the small air bubbles shrink and collapse implosively causing a pressure shock which can severely damage parts. This implosion causes cavitation erosion damage to the bearing side walls adjacent the gear side faces. In order to eliminate or minimize the effects of cavitation erosion, the problem must be faced of minimizing damage caused by the presence of air in solution. This is in contrast to gear pump structures which attempt to evacuate the air in the liquid.

In using gear pumps during high altitude conditions, a majority of the air is capable of being absorbed by the viscous liquid, such as oil. When there is a large volume of air in solution, the air acts as a shock absorber because the larger air bubbles absorb the energy of the shock wave created at the "hydraulic front". Consequently, those air bubbles small enough to implode will not cause cavitation erosion because of the shock absorption of the larger bubbles. However, major cavitation erosion problems arise when the system reaches the point of air saturation. In aircraft applications, the inlet port pressure may be as small as one psi and the discharge outlet pressure may be forty psi. Consequently, there is practically an instantaneous hydraulic front and an instantaneous "spike" of liquid entering the gear teeth spaces. Cavitation erosion results and literally forms holes with a corrosive appearance on the bearing or side plate end walls of the pumping chamber.

This invention is directed to solving the cavitation erosion problem described above.

SUMMARY OF THE INVENTION

An object, therefore, of the invention is to provide a new and improved rotary fluid displacement pump, particularly a gear pump having means to eliminate or minimize the effects of cavitation erosion.

In the exemplary embodiment of the invention, a gear pump is shown to include at least a pair of intermeshing gears. A housing defines a pumping chamber having peripheral walls surrounding and in sealing contact with the circumference of the gears between an inlet port and a discharge port. Bearing wall means are adapted to engage adjacent side faces of the gears in substantially sealing relation. Generally, means are provided in the bearing wall means for progressively admitting pressure to the gear tooth spaces as the gear teeth move toward the discharge port.

Specifically, the pressure admitting means include groove means in the bearing wall means. The groove means are arcuately shaped and diverge toward the discharge port from a point intermediate the inlet and discharge ports. The groove means begin at the outer periphery of the pumping chamber and widen inwardly toward the roots of the gear teeth. The groove means communicate with the discharge port to allow compressed air in the liquid to gradually be displaced by liquid under pressure from the pump discharge.

Although the pressure admitting means or groove means are disclosed herein as formed in the bearing wall means, the invention contemplates the groove means to be formed anywhere in the wall means defining the pumping chamber, such as in the peripheral wall means of the housing, to provide a variable port discharge "window" which will progressively admit pressure to the gear tooth space as the gear moves toward the discharge.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a section through a gear pump having three separate pumping chambers;

FIG. 2 is an elevation depicting the side walls of a pair of side bearings in a gear pump of the prior art;

FIG. 3 is a fragmented section, on an enlarged scale, taken generally in the direction of the multiple locations defined by arrows 3—3 in FIG. 1;

FIG. 4 is a fragmented section, on an enlarged scale, taken generally in the direction of the multiple locations defined by arrows 4—4 in FIG. 1;

FIG. 5 is a somewhat schematic, perspective view of a bearing block according to the invention, exploded ou of its position of assembly with the other components of the gear pump; and FIG. 6 is an elevation taken generally in the direction of arrows 6—6 of FIG. 5, solely illustrating the end faces of two intermeshed gears of the gear pump.

DETAILED DESCRIPTION OF THE PREFERRED EMBODIMENT

Referring to the drawings in greater detail, and first to FIG. 1, a composite positive displacement gear pump, generally designated 10, is of a type used in a hydraulic network with a turbine engine. Composite gear pump 10 actually has three separate pumping chambers 12*a*,12*b*,12*c* separated longitudinally in an elongated or tubular housing 14. Pumping chamber 12*a* is defined axially by end bearing blocks 16*a*,16*b* and intermediate bearing blocks 18*a*,18*b*. Pumping chamber 12*b* is defined axially by intermediate bearing blocks 18*a*,18*b* and intermediate bearing blocks 20*a*,20*b*. Pumping chamber 12*c* is defined axially by intermediate bearing blocks 20*a*,20*b* and end bearing blocks 22*a*,22*b*. A pair of intermeshed rotary gears 24 are disposed in pumping chamber 12*a* between bearing blocks 16*a*,16*b* and 18*a*,18*b*. A pair of intermeshed gears 26 are disposed in pumping chamber 12*b* between bearing blocks 18*a*,18*b* and 20*a*,20*b*. A pair of intermeshing gears 28 are disposed axially within pumping chamber 12*c* between bearing blocks 20*a*,20*b* and 22*a*,22*b*. All the gears are rotated by a common drive shaft means 30.

The arrangement described above in relation to gear pump 10 in FIG. 1, includes three inlet ports (not shown) for the respective pumping chambers 12*a*,12*b*, and 12*c* with a single discharge port defined by a manifold (not shown) providing a common pump discharge. In the hydraulic network of the turbine engine, oil is fed from gear pump 10 to one or more pressure pumps where the oil is pressurized and pumped through an artery system to a plurality of basic locations where the oil is sprayed for lubrication, for instance. The oil drains from those locations into a sump or gear box. The oil then is scavenged and lifted back to gear pump 10. Under such a system, gear pump 10 must be capable of displacing both oil and air, and, consequently, there is a greater tendency of cavitation erosion, as described above.

FIG. 2 illustrates a pair of bearing blocks 32 fabricated according to prior concepts, with each bearing block including a planar wall 34 adapted to engage side faces of gears in substantially sealing relation within a gear pump. Conventional trapping grooves 36 at the inlet side of the pump and trapping grooves 38 at the discharge side of the pump are formed in walls 34. The trapping grooves comprise pressure relief grooves as the gear teeth go into and out of mesh. It is on walls 34 of bearing blocks 32 that cavitation erosion takes place.

FIGS. 3 and 4 illustrate bearing blocks fabricated according to the invention. It should be noted that FIG. 3 is taken at multiple locations in the same direction along the length of gear pump 10 (FIG. 1), and FIG. 4 is taken along a plurality of locations along the gear pump in a direction opposite that of FIG. 3. This has been done in order to avoid unnecessary duplications of figures. In other words, the faces of bearing blocks 16*a*,16*b*; 18*a*,18*b*; and 20*a*,20*b* which face downwardly as viewed in FIG. 1 have identical constructions on the end walls thereof facing the pump gears. Similarly, bearing blocks 18*a*,18*b*; 20*a*,20*b*; and 22*a*,22*b* all have similar end walls facing in an upward direction as viewed in FIG. 1. For purposes of illustration, FIG. 3 will be described in relation to bearing blocks 16*a*,16*b*, and FIG. 4 will be described in relation to bearing blocks 22*a* and 22*b*, since the inwardly facing walls of these sets of blocks face in opposite directions.

More particularly, each set of bearing blocks 16*a*,16*b* and 22*a*,22*b* are mounted within housing 14 whereby each bearing block has a generally planar bearing wall means 40 adapted to engage ad]acent side faces of gears 24 for bearing blocks 16*a*,16*b* and gears 28 for bearing blocks 22*a*,22*b* in substantially sealing relation. Housing 14 combines with the bearing blocks to define a pumping chamber. The housing has annular peripheral walls 42 in sealing contact with the circumference of the gears between an inlet port 44 and a discharge port 46. As stated above, with the gear pump arrangement of FIG. 1, the inlet ports are separate inlet zones and the discharge ports may lead to a manifold into a common discharge zone. Each bearing block 16*a*,16*b* and 22*a*,22*b* has trapping grooves 36 at the inlet ports 44 and trapping grooves 38 at the discharge ports 46 to provide pressure relief groove means in the vicinities where the gear teeth go into and out of mesh, as described in relation to FIG. 2.

The invention contemplates a variable metering system communicating with discharge ports 46 for reducing the magnitude of energy and the severity of instantaneous implosion at the discharge ports to spread the implosion gradually over a greater surface area and, thereby, to eliminate or minimize cavitation erosion on bearing walls 40. In essence, the invention contemplates a variable discharge port "window". In a broad sense, the invention contemplates means in the surrounding wall means of the pumping chambers for progressively admitting pressure to the gear teeth as the gear teeth move toward discharge ports 46.

More particularly, grooves 48 are formed in walls 40 of bearing blocks 16*a*–22*b* for progressively admitting pressure from discharge ports 46 to the gear teeth. It can be seen in FIGS. 3 and 4 that grooves 48 are generally arcuately shaped and diverge toward discharge ports 46 from a point 50 intermediate inlet ports 44 and discharge ports 46. It also can be seen that the grooves begin, at points 50, at the outer periphery of the pumping chamber defined, in part, by peripheral walls 42 of housing 14, and widen inwardly toward the roots of the gear teeth. Grooves 48 communicate with discharge ports 46 to allow compressed air in the pumped liquid to be gradually displaced by liquid under pressure from the pump discharge.

It should be understood that grooves 48 in walls 40 of the bearing blocks comprise a preferred form of the invention. However, the invention contemplates other means for variably metering the discharge liquid into the system to gradually displace the compressible medium, in solution, by fluid from the pump discharge. For instance, it is readily apparent from FIGS. 3 and 4 that tapered groove means could be formed in peripheral walls 42 of housing 14 in areas similar to the location of grooves 48 in the planar walls 40 of the bearing blocks. In essence, it can be seen that the invention contemplates a variable discharge port "window" for progressively allowing compressed air in the liquid to be gradually displaced by liquid under pressure from the pump discharge.

FIGS. 5 and 6 illustrate the bearing blocks in conjunction with respectively adjacent pump gears. For purposes of illustration, these figures can be assumed as being taken at the top of gear pump 10 in FIG. 1. The positions of bearing blocks **16*b*,18*a* and 18*b*, along with gears 24 are readily apparent. The gradual tapering or widening of variable groove 48 also can be seen clearly on the perspective depiction of bearing block 18**.

From the foregoing, it can be seen that a new and improved gear pump has been provided with means for eliminating or minimizing the effects of cavitation erosion by reducing the severity of instantaneous implosion of air in solution within the pumped liquid. The implosion is spread gradually over a greater surface area, as provided by grooves 48, than in conventional gear pumps which create an instantaneous "hydraulic front" which causes air to implode back into solution which, in turn, causes cavitation damage to bearing walls 40.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A gear pump, comprising:

a pair of intermeshing gears;

a housing defining a pumping chamber having peripheral walls surrounding and in sealing contact with the circumference of the gears between an inlet port and a discharge port;

bearing wall means adapted to engage adjacent side faces of the gears in substantially sealing relation; and groove means in the bearing wall means for progressively admitting pressure to the gear teeth as the gear teeth move toward the discharge port, said groove means beginning at the outer periphery of the pumping chamber and widening inwardly toward the roots of the gear teeth.

2. A gear pump as set forth in claim 1 wherein said groove means communicate with the discharge port to allow compressed air in the liquid to be gradually displaced by liquid under pressure from the pump discharge.

3. In a gear pump of the type in which a pair of intermeshing gears are mounted in a plumbing chamber defined by peripheral wall means in sealing contact with the circumference of the gears and bearing wall means adapted to engage the adjacent side faces of the gears forcing liquid from an inlet port to a discharge port, and arcuately shaped groove means in the wall means defining the pumping chamber, the groove means diverging toward the discharge port from a point intermediate the inlet and discharge ports with the groove means beginning at the outer periphery of the pumping chamber and widening inwardly toward the roots of the gear teeth.

4. In a gear pump as set forth in claim 3 wherein said groove means communicate with the discharge port to allow compressed air in the liquid to be gradually displaced by liquid under pressure from the pump discharge.

5. In a gear pump which includes a pair of intermeshing gears, and a housing defining a pumping chamber having peripheral walls surrounding and in sealing contact with the circumference of the gears between an inlet port and a discharge port whereby the gears force liquid from the inlet port, to the outlet port, bearing means comprising end wall means adapted to engage the adjacent side faces of the gears substantially sealing relation, and arcuately shaped groove means in the end wall means diverging toward the discharge port from a point intermediate the inlet and discharge ports for progressively admitting pressure to the gear teeth as the gear teeth move toward the discharge port, the groove means beginning at the outer periphery of the pumping chamber and widening inwardly toward the roots of the gear teeth.

6. In a gear pump as set forth in claim 5, wherein said groove means communicate with the discharge port to allow compressed air in the liquid to be gradually displaced by liquid under the pressure from the pump discharge.

* * * * *